US005299224A

United States Patent [19]

Maubert

[11] Patent Number: 5,299,224

[45] Date of Patent: Mar. 29, 1994

[54] WALL ASSEMBLY FOR INDUCTION FURNACE

[75] Inventor: Michel Maubert, Genevilliers, France

[73] Assignee: La Carbone Lorraine, Courbevoie, France

[21] Appl. No.: 801,933

[22] Filed: Dec. 3, 1991

[30] Foreign Application Priority Data

Dec. 21, 1990 [FR] France ..... 90 16585

[51] Int. Cl.[5] ..... F27D 1/00

[52] U.S. Cl. ..... 373/71; 373/72; 373/73; 373/75; 65/347; 65/182.1; 52/474; 110/336; 432/248

[58] Field of Search ..... 373/71, 72, 73, 75, 373/30, 44, 45, 155; 219/10.491, 10.79; 432/248, 247; 110/336, 338, 99; 52/474; 75/65; 65/182 R, 347

[56] References Cited

U.S. PATENT DOCUMENTS 3,210,455 10/1965 Sedlatschek .
3,568,611 3/1971 Konrad ..... 110/99
3,767,375 10/1973 Brichard et al. ..... 65/182 R
3,775,091 11/1973 Cliteo et al. ..... 75/65
4,411,621 10/1983 Miller ..... 432/247
4,638,617 1/1987 James ..... 54/474
4,900,249 2/1990 McCollum et al. ..... 432/248

FOREIGN PATENT DOCUMENTS 2364590 4/1978 France .

*Primary Examiner*—Bruce A. Reynolds
*Assistant Examiner*—Tu Hoang
*Attorney, Agent, or Firm*—Dennison, Meserole, Pollack & Scheiner

[57] ABSTRACT

A graphite block for an induction furnace in the form of a right prism formed from a plurality of plates associated along adjacent end faces parallel to the axis of the prism. Each plate includes a longitudinal recess opening into its top face adjacent a first end and a longitudinal recess opening into its bottom face adjacent an opposite end. Each end face is provided with a flexible graphite joint. The association of plates results from a partial interfitting of a top face longitudinal recess of one plate with a bottom face longitudinal recess of a second plate, the recesses being adapted to leave a void of polygonal section between the plates. This void is occupied by a graphite key of similar section divided over its length into two parts meeting along an oblique surface.

5 Claims, 2 Drawing Sheets

WALL ASSEMBLY FOR INDUCTION FURNACE

BACKGROUND OF THE INVENTION

The invention concerns a graphite block comprising a plurality of components and designed to equip a furnace heated by induction.

DESCRIPTION OF RELATED ART

Persons skilled in the art of induction heating know that it may operate in two ways:

- either by direct induction into the parts to be heated, provided they are electrically conductive
- or by indirect heating of the parts by means of a generally cylindrical block; parts made of any material may be heated by this second method.

In the latter case the block is assumed to react like the single turn of the secondary of a transformer, in which the primary is formed by the copper solenoid surrounding the block. Under these conditions, when the solenoid is supplied with alternating current, it gives rise to an electric current in the block, of a strength proportional to that flowing in the primary. This causes heat emission by the Joule effect, and the heat is then transmitted to parts placed inside the block.

When large items have to be heated it is difficult to construct blocks all in one piece, particularly when they are to be made of graphite. Cylindrical blocks of large dimensions, either in height or diameter, cannot be formed by current methods of producing this equipment.

A partial solution to the problem is provided in document FR-A-2 364 590. This describes blocks comprising an assembly of a plurality of parts, where assembly may be by dovetail, oblique scarf, oblique scarf with a double dovetail, oblique notch and half-thickness notch with a dowel.

However, since the assembly methods provided do not always produce joints of adequate quality, electrical discontinuities may occur and the performance of blocks made in this way will suffer.

SUMMARY OF THE INVENTION

The invention aims to avoid the above disadvantages and particularly to enable multi-component graphite blocks to be produced, which will perform better than prior art blocks and/ or blocks with larger dimensions.

The object of the invention is a graphite block for an induction furnace, the lateral surfaces of which are arranged to form a right prism and made up of identical plates, the plates being combined at their ends along a surface parallel with the axis of the prism, characterised in that for a prism of 2n sides there are n plates, that each of the plates is provided laterally with two identical longitudinal recesses, opening respectively onto one side of said plate and onto the other, that the combination of said plates results from partially fitting one of the recesses into the recess in the adjacent component, so as to leave a space of polygonal section between them over their whole length, and that said space is occupied by a graphite key of substantially similar section, which is divided into two parts over its whole length, the two parts meeting along an oblique surface.

To form the block, the parts as described are assembled by fitting the recesses into one another, then one part of the key is threaded into the remaining space and the whole arrangement is locked together by threading in the other foot from head to foot and forcing it in with a sledgehammer.

One thus has an arrangement formed by self-closing keying which forms an extremely rigid block. Its action is quite comparable to that of a single-piece block, particularly as far as its electrical properties are concerned, and no anomalies are found at the joins.

It is preferable to stick a strip of flexible graphite, such as that which carries the trademark "PAPYEX", on the end surface of a component in contact with the adjacent component, so as to perfect the electrical connection between components.

The dimension of the block according to the invention are limited technologically by the dimensions of the standard blocks of solid graphite from which the components are shaped. The diameter can be made larger by increasing the number of components, whereas the height is strictly limited to that of the pieces of solid graphite. In accordance with the invention, a modular structure may be used, that is to say, a plurality of identical prisms or modules can be made and stacked on one another with a strip of PAPYEX placed between them, to give a single block of the desired height.

Each component may be shaped in a particular way to provide it with means for facilitating its handling and installation.

These means may be, for example:

- blind holes with an axis perpendicular to the surfaces of the component, enabling slings to be fitted for handling the modules;
- positioning holes, which are used when a plurality of modules are installed. These holes have an axis parallel with that of the module and are located opposite one another in the bases of each of the modules: the hole in one base is blind, and that in the other base opens into the hole provided for handling.

When installing the components the first module is first positioned. Graphite plugs are then placed in its handling holes and slugs in its positioning holes. The tops of the slugs will be contained in the positioning holes of the second module.

The invention has many advantages, in particular:

- the exclusive use of graphite, which makes the coefficients of expansion very homogeneous throughout the block so that there are virtually no anomalies at the joins;
- the use of identical components, which facilitates their shaping;
- the use of PAPYEX at critical locations, resulting in excellent joining of the components;
- easy replacement of a faulty element by exerting pressure on the smaller-area part of the key which can be seen in the recess, using a wooden wedge; this part is thus released and frees the other, so that the components can be separated.

BRIEF DESCRIPTION OF THE DRAWINGS

The invention will be understood better from the accompanying drawings, in which.

DESCRIPTION OF THE PREFERRED EMBODIMENTS

Figure 1:
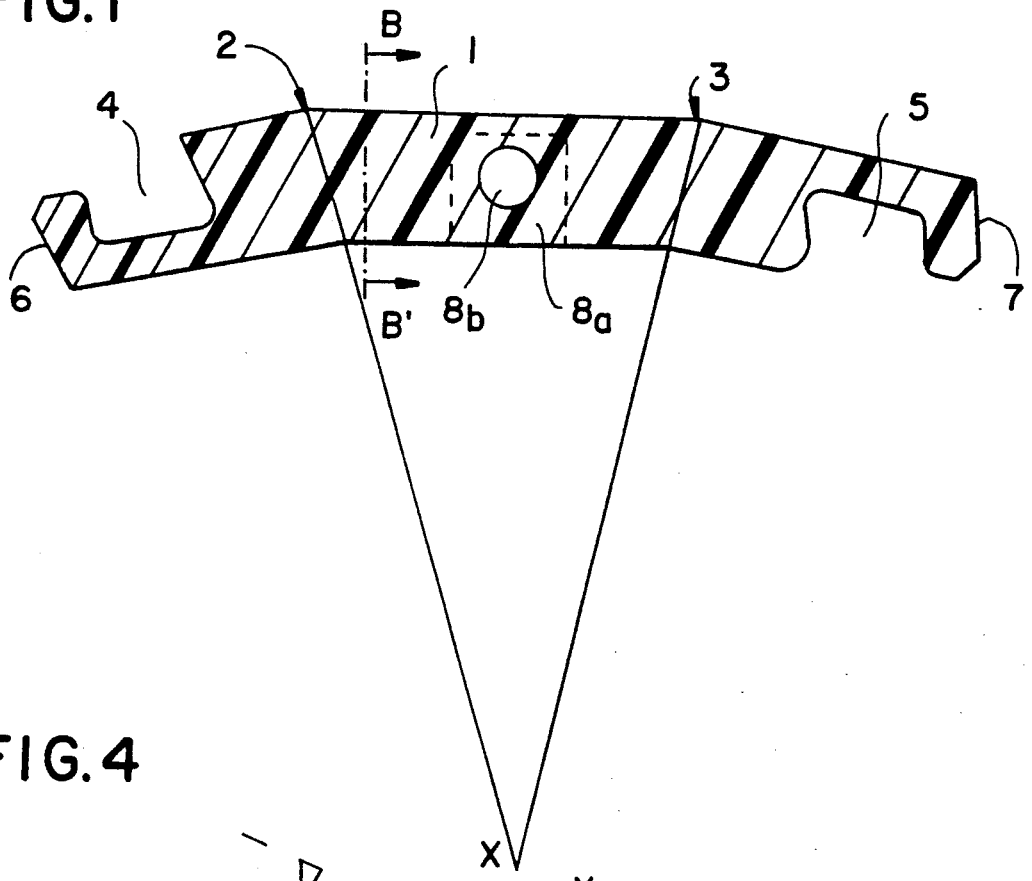
FIG. 1 is a view in cross-section perpendicular to the axis XX' of the prism of a component

In FIG. 1 a plate 1 can be seen, with an outline corresponding to one surface of the block, which is bounded by the angles 2 and 3 and extended by two half surfaces, so that a prism of 2n sides can be formed with n plates. The plate is provided with two recesses 4 and 5 which respectively open, one at one side of the plate and one at the other, and is combined with the adjacent plates by means of the end surfaces 6 and 7 of the recesses. A handling hole 8*a* and a positioning hole 8*b* have been made in the plate.

Figure 2:
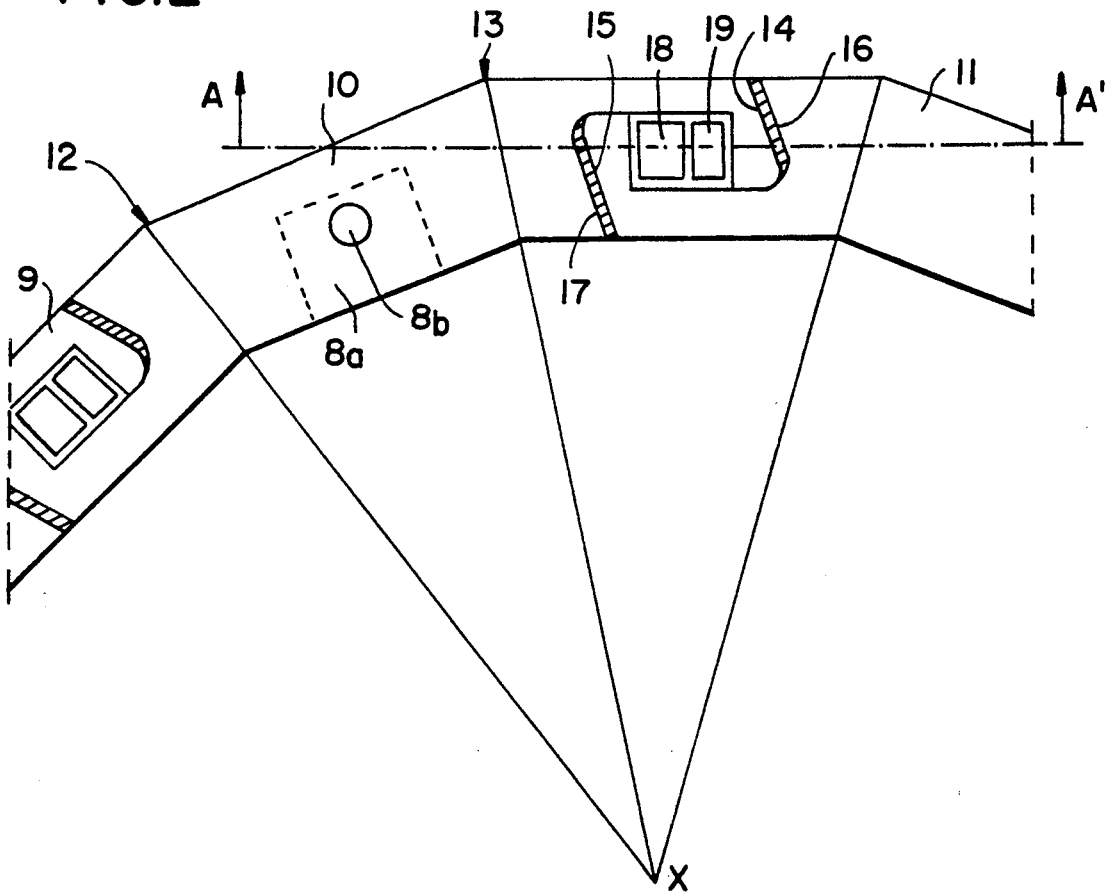
FIG. 2 is a view of an assembly of three components in the same cross-section

An assembly of three components 9, 10 and 11 can be seen in FIG. 2, the component 10 having two angles 12 and 13. The components 10 and 11 have their respective end surfaces 14 and 15 equipped with joints or seals 16 and 17. The two parts 18 and 19 of the key are placed in the space left free by the recesses. Holes 8*a* and 8*b* are again provided.

Figure 3:
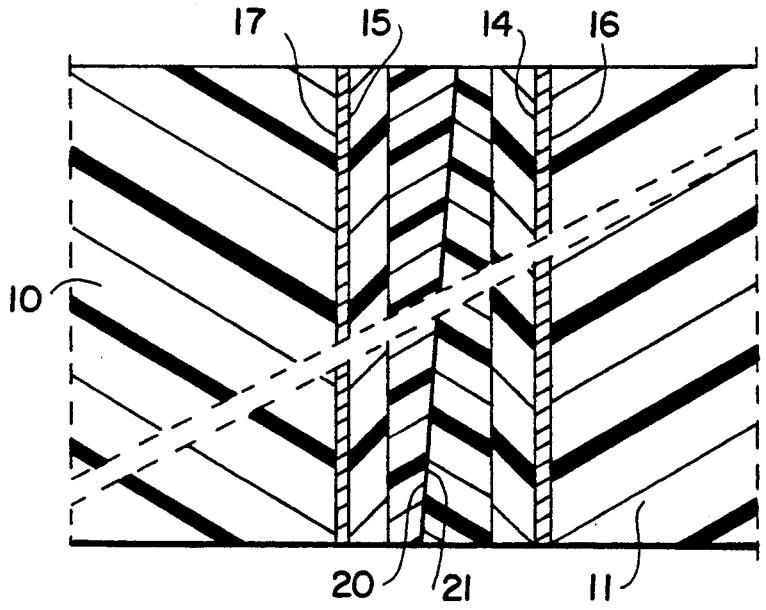
FIG. 3 is a view of FIG. 2 in a cross-section A-A' parallel with the axis of the prism.

The components 10 and 11 are shown in FIG. 3, with their respective end surfaces 14 and 15 equipped with their joints 16 and 17. The two parts 18 and 19 of the key are placed in the space left free by the recesses, and the surfaces 20 and 21 of the key which are in contact extend obliquely over the whole height of the prism.

Figure 4:
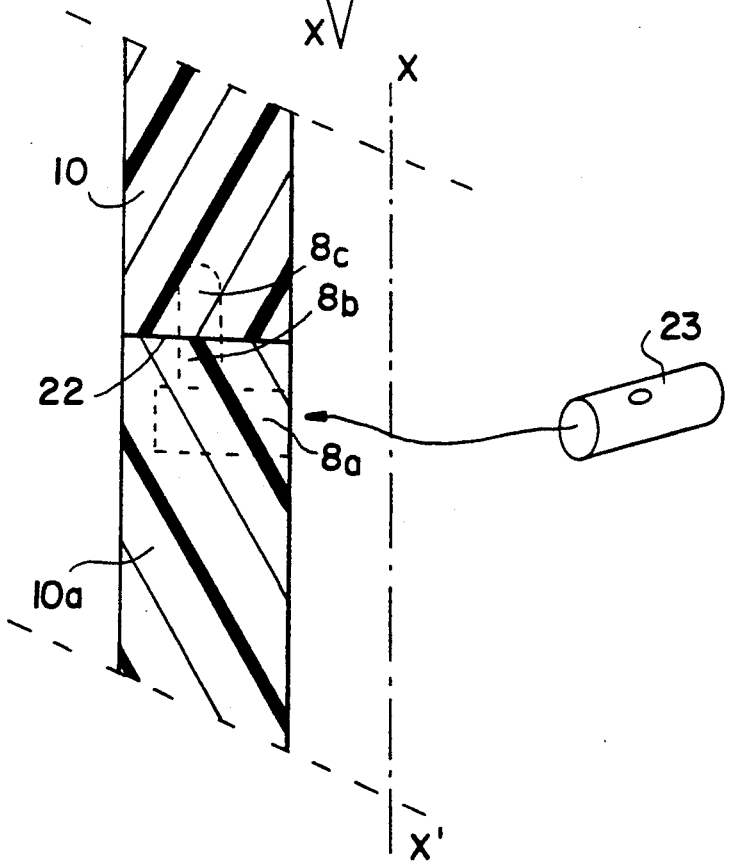
FIG. 4 is a fragmentary view of a resistor formed by superposing two prisms, in a section parallel with its axis.

FIG. 4, which is a vertical section, shows a plate 10 forming one of the prisms, located above a plate 10*a* forming another prism; the two prisms are separated by a joint or seal 22 of PAPYEX. Positioning holes 8*b* and 8*c* are formed in the bottom of each plate, and a plug 23 can be placed in the handling hole 8*a*.

EXAMPLES

1. A block which has a 32-sided polygon as its base and a capacity of 2.8 m3 is made by combining two modules, each having a height of 750 mm and an external outline inscribed in a circle with a diameter of 1 650 mm.

2. A block which has a 40-sided polygon as its base and a capacity of 14 m3 is made by combining four modules, each having a height of 850 mm and an external outline inscribed in a circle with a diameter of 2 400 mm.

What is claimed is:

1. A graphite block for an induction furnace in the form of a right prism having a plurality of lateral sides parallel to an axis, said sides formed of a plurality of graphite plates having an inner and an outer surface opposite to each other and two end faces parallel to said axis and perpendicular to said inner and outer surfaces, wherein each end face of a plate is adjacent to an end face of another plate, each said plate including two longitudinal recesses with one recess near each of said end faces and parallel to said axis, wherein one recess opens into said inner surface and the other recess opens into said outer surface, the recess opening into said inner surface facing toward the recess opening into the outer surface of an adjacent plate to form a polygonal space over a whole length of said plates, said end faces being interfitted with each other by graphite keys of oblique surfaces occupying said polygonal space, said keys being divided over their length into two portions, flexible graphite joints being provided outside said polygonal space and inside a gap formed between end faces of adjacent interfitted plates.

2. The block of claim 1, wherein each plate is provided with at least one hole.

3. The block of claim 2, wherein said at least one hole is parallel to said axis surface.

4. The block of claim 2, wherein said at least one hole is perpendicular to said lateral surface.

5. The block of claim 1, comprising a plurality of superposed right prisms, each of said superposed right prisms comprising a plurality of plates.

* * * * *